US012781408B2

(12) United States Patent
Kim et al.

(10) Patent No.: US 12,781,408 B2
(45) Date of Patent: Nov. 3, 2026

(54) METHOD AND DEVICE FOR PROVIDING GUIDING INFORMATION AFTER WASHING HAS BEEN FINISHED

(71) Applicant: LG Electronics Inc., Seoul (KR)

(72) Inventors: Sang Won Kim, Seoul (KR); Tae Yoon Kim, Seoul (KR); Jung Hyub Lee, Seoul (KR); Taekyo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 158 days.

(21) Appl. No.: 18/730,174

(22) PCT Filed: May 27, 2022

(86) PCT No.: PCT/KR2022/007579
§ 371 (c)(1),
(2) Date: Jul. 18, 2024

(87) PCT Pub. No.: WO2023/146031
PCT Pub. Date: Aug. 3, 2023

(65) Prior Publication Data

US 2025/0129533 A1 Apr. 24, 2025

(30) Foreign Application Priority Data

Jan. 25, 2022 (KR) ..... 10-2022-0010793

(51) Int. Cl.
*D06F 34/05* (2020.01)
*D06F 103/08* (2020.01)
(Continued)

(52) U.S. Cl.
CPC ..... *D06F 34/05* (2020.02); *D06F 2103/08* (2020.02); *D06F 2103/12* (2020.02); *D06F 2103/38* (2020.02); *D06F 2105/60* (2020.02)

(58) Field of Classification Search
CPC .. D06F 34/05; D06F 2103/08; D06F 2103/12; D06F 2103/38; D06F 2105/60;
(Continued)

(56) References Cited

U.S. PATENT DOCUMENTS

2018/0305856 A1* 10/2018 Welch ..... G06Q 20/18
2020/0248356 A1 8/2020 Kwon et al.
2023/0132718 A1* 5/2023 Scheckelhoff ..... D06F 58/46 34/527

FOREIGN PATENT DOCUMENTS

CN 109706690 A 5/2019
CN 113403804 A 9/2021
(Continued)

*Primary Examiner* — Daryl C Pope
(74) *Attorney, Agent, or Firm* — Birch, Stewart, Kolasch & Birch, LLP

(57) ABSTRACT

The present invention relates to a technique pertaining to a method and device for providing guiding information after washing is finished, and the method for providing guiding information after washing is finished, according to an embodiment of the present invention, comprises: a step in which a server communication unit of a management server receives, from a washer, a first message notifying that washing is finished; a step in which the server communication unit receives, from a dryer for drying the laundry from the washer, a second message notifying the start of drying; a step in which a server control unit of the management server calculates, using the first message and the second message, the time during which the laundry was left in the washer; and a step in which the server control unit controls a notification process of the washer or of the dryer by comparing the time during which the laundry was left inside with a reference time.

16 Claims, 8 Drawing Sheets

(51) Int. Cl.
*D06F 103/12* (2020.01)
*D06F 103/38* (2020.01)
*D06F 105/60* (2020.01)

(58) Field of Classification Search
CPC ..... D06F 33/44; D06F 29/005; D06F 34/32; D06F 2105/56; D06F 2105/58; D06F 34/18
See application file for complete search history.

(56) References Cited

FOREIGN PATENT DOCUMENTS

| | | | |
|---|---|---|---|
| JP | 2015-70945 | A | 4/2015 |
| KR | 10-2005-0066329 | A | 6/2005 |
| KR | 10-2019-0084566 | A | 7/2019 |
| KR | 10-2193055 | B1 | 12/2020 |
| KR | 10-2021 | A | 3/2021 |

* cited by examiner

【Figure 1】
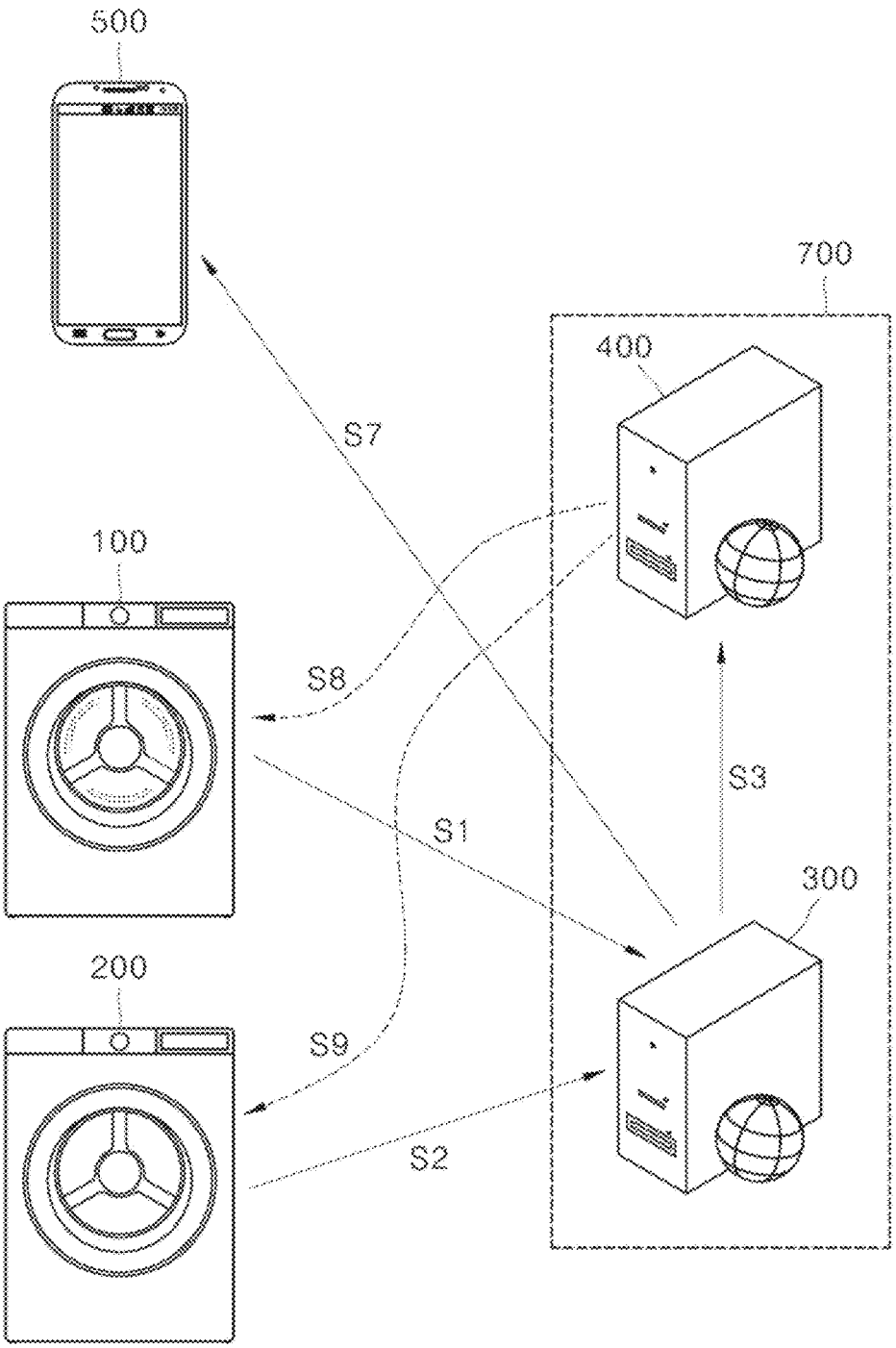

【Figure 2】
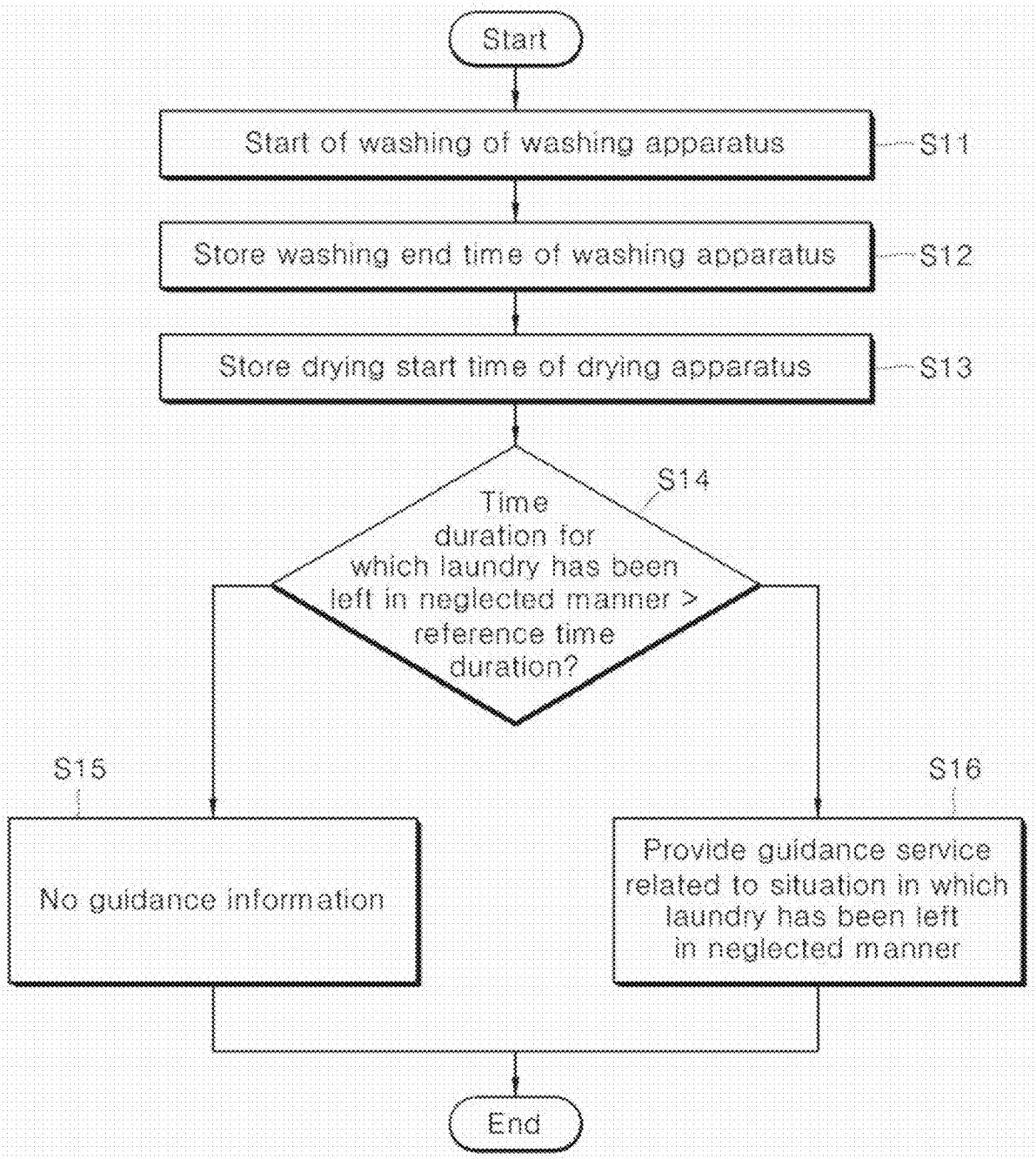

【Figure 3】
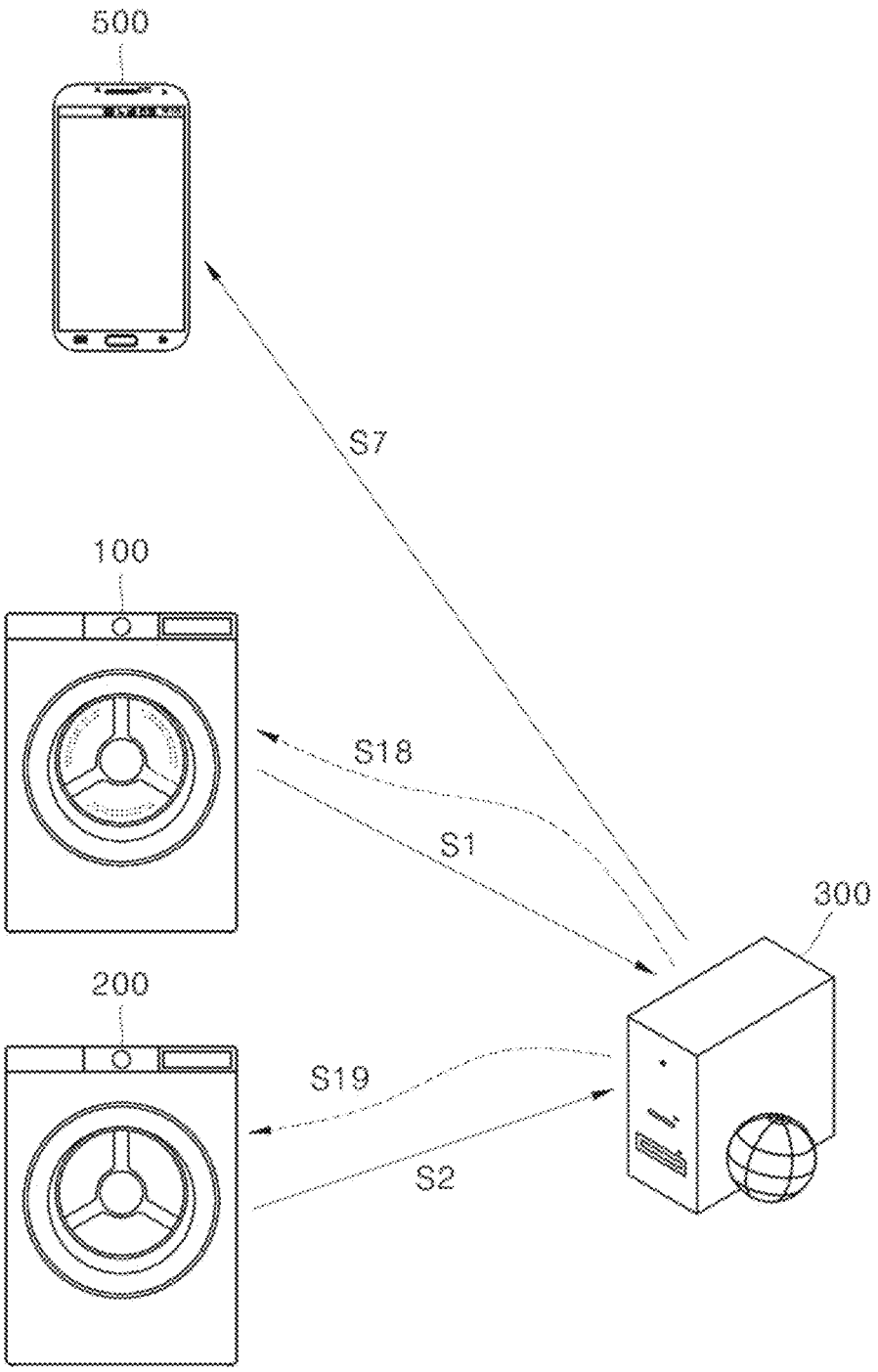

【Figure 4】
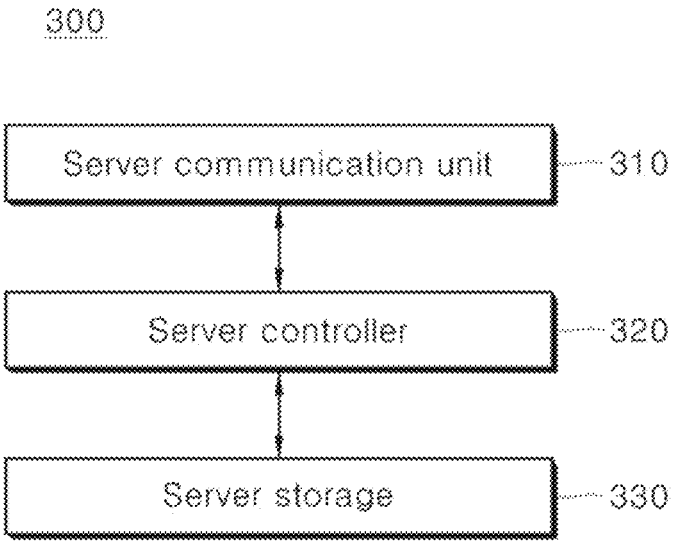
【Figure 5】
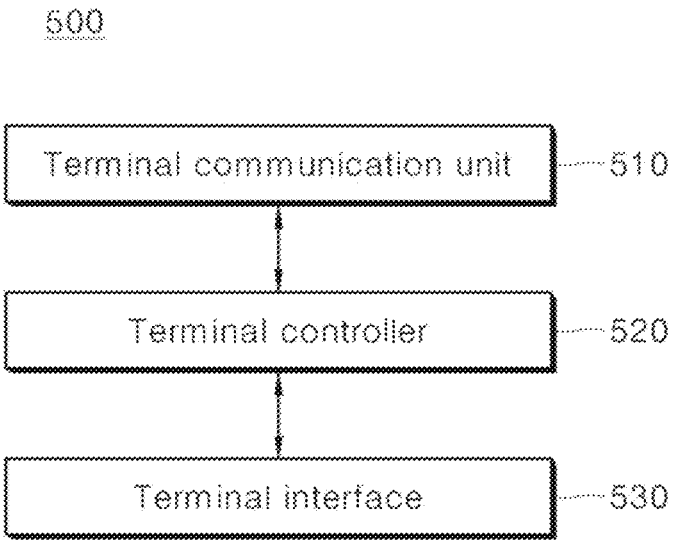

【Figure 6】
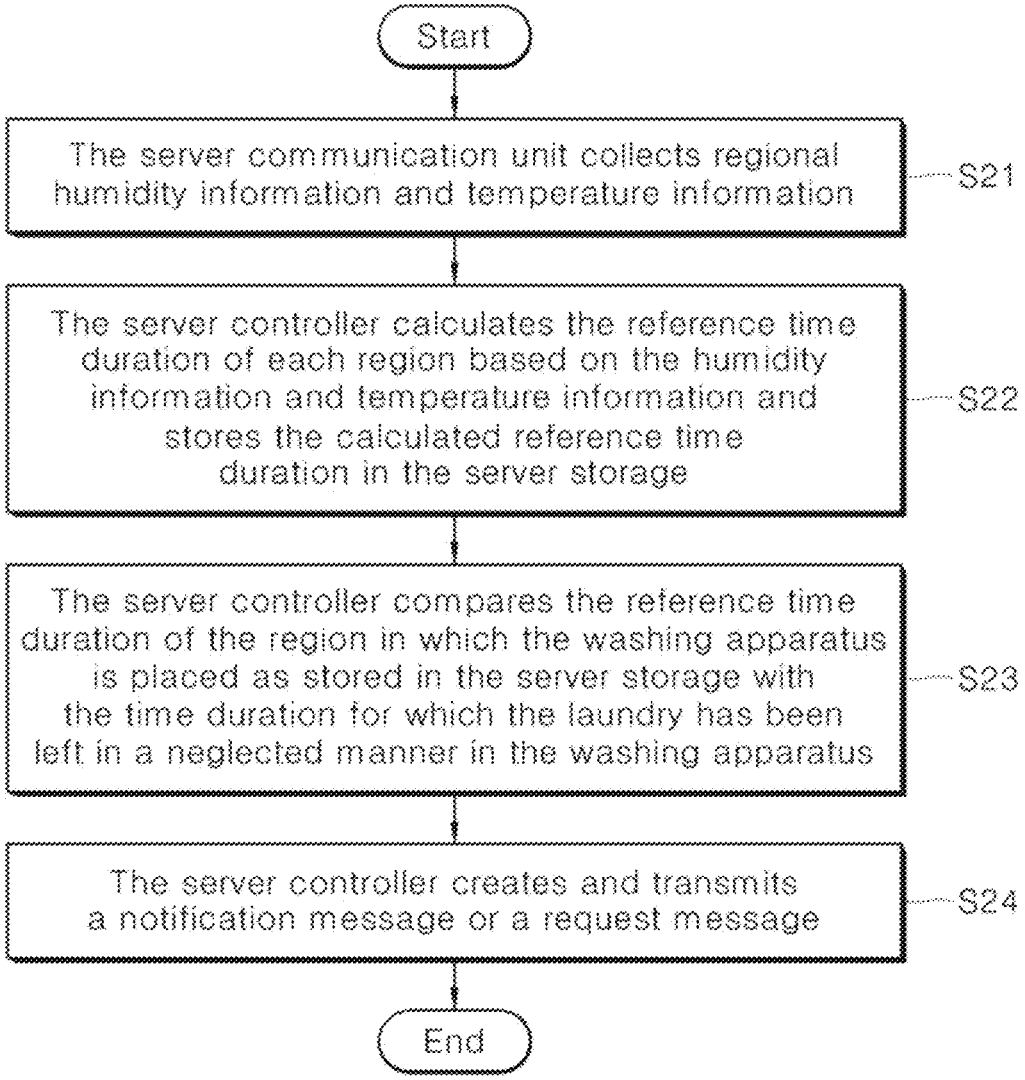

【Figure 7】
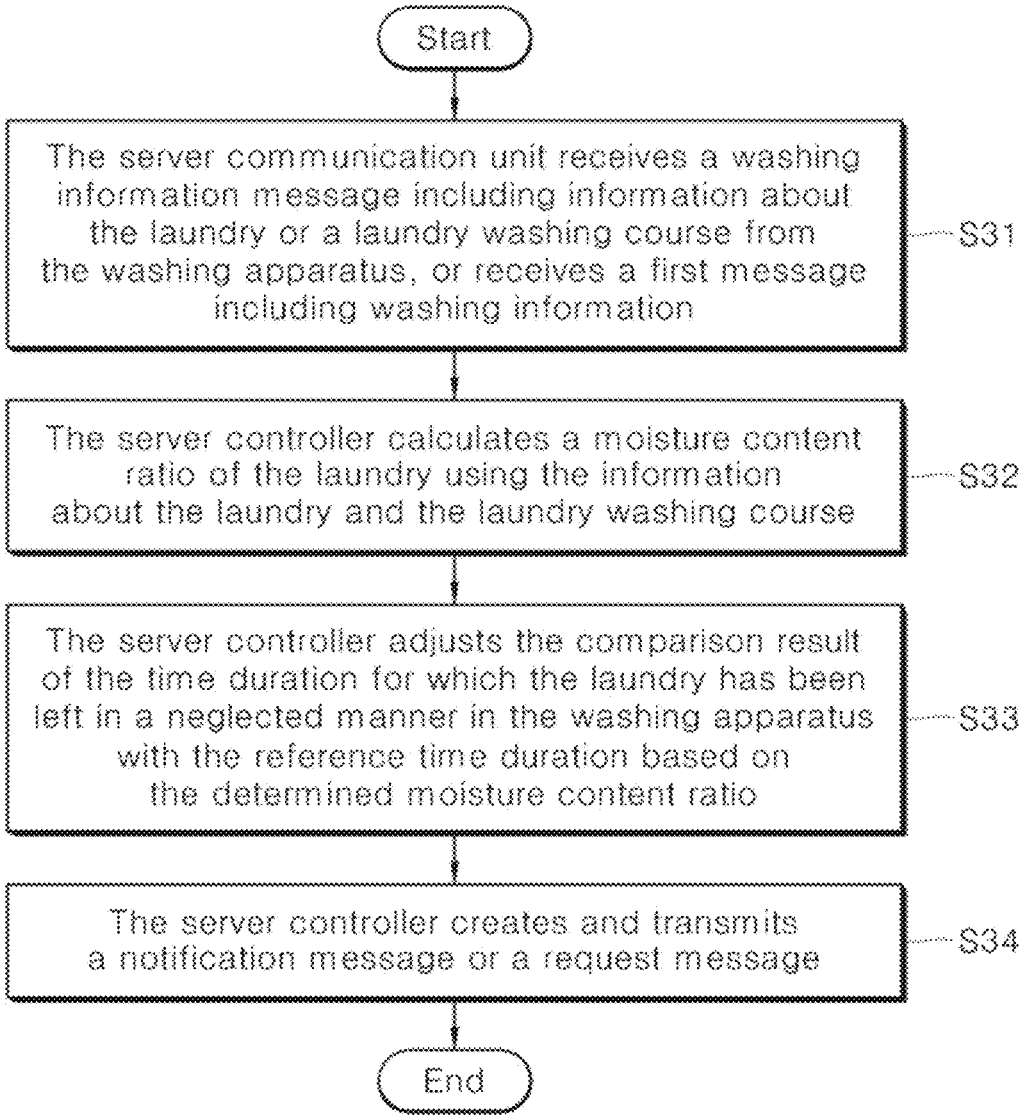

【Figure 8】
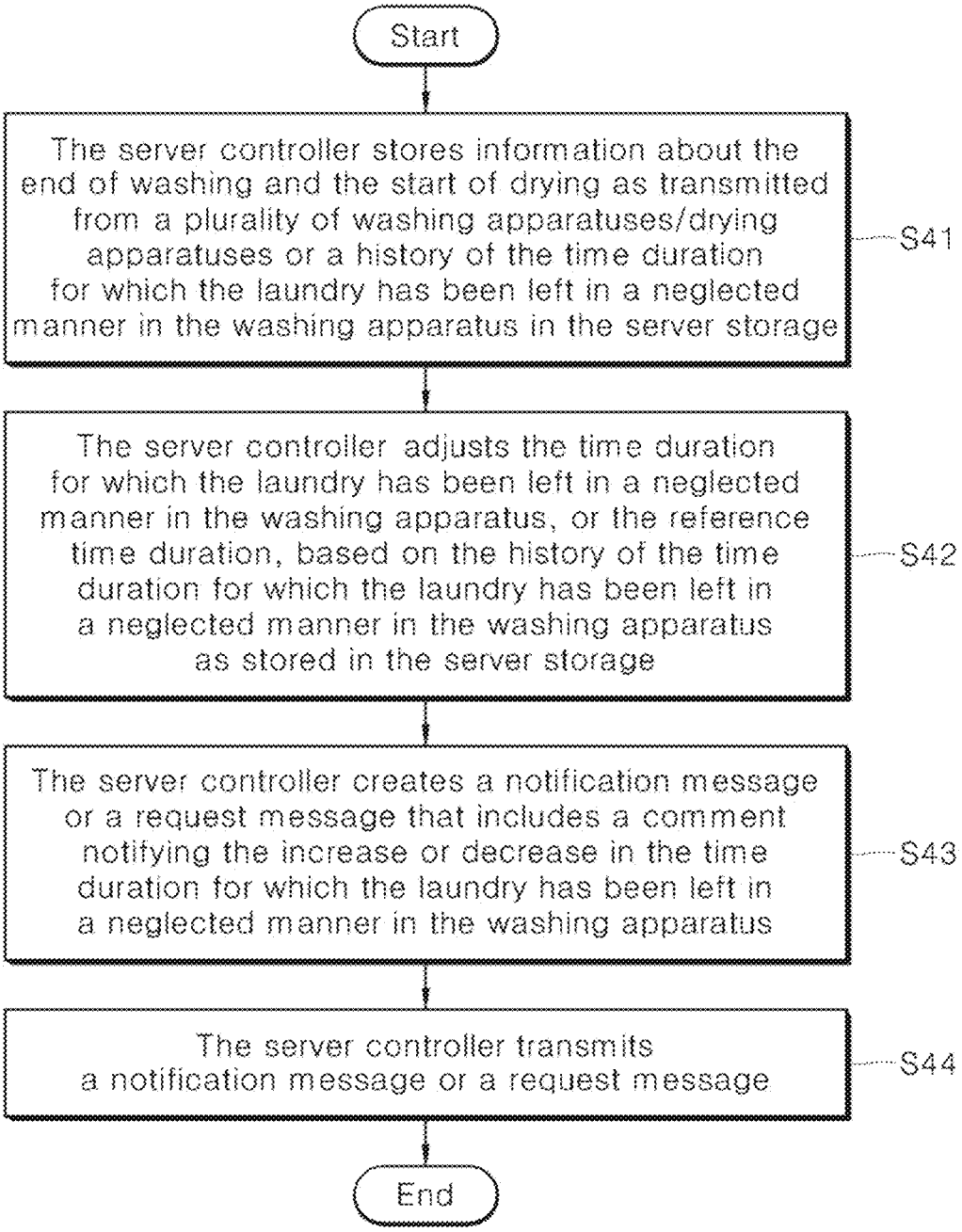

【Figure 9】
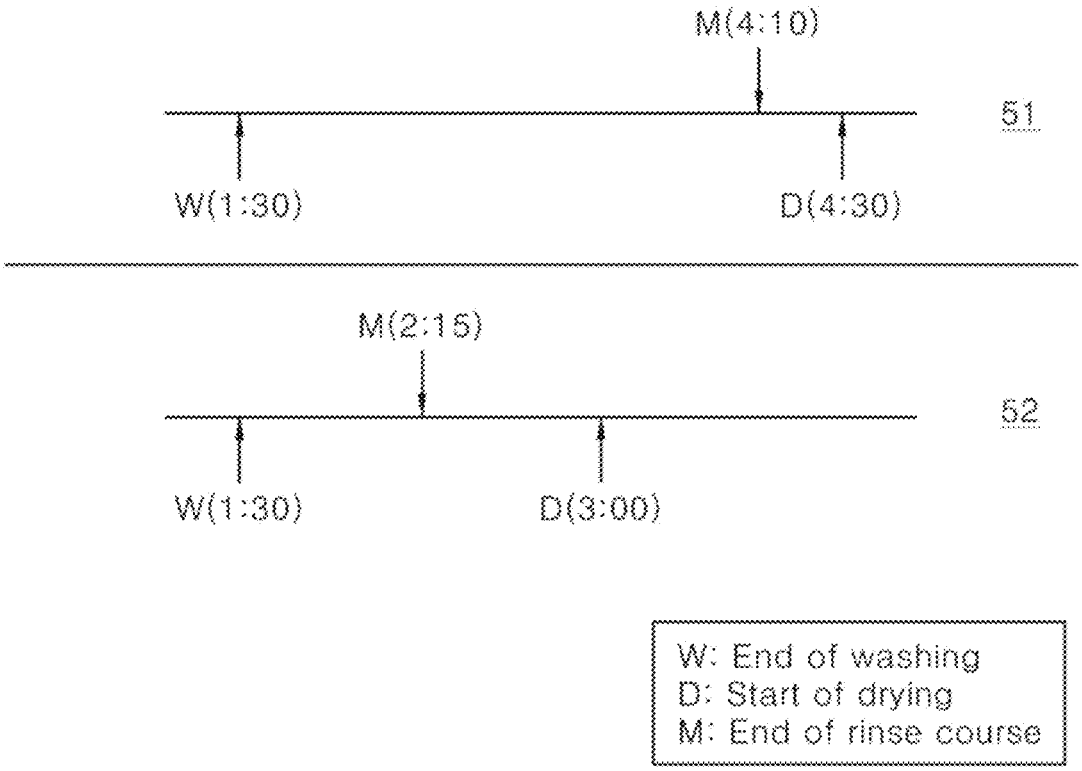

METHOD AND DEVICE FOR PROVIDING GUIDING INFORMATION AFTER WASHING HAS BEEN FINISHED

CROSS REFERENCE TO RELATED APPLICATIONS

This application is the National Phase of PCT International Application No. PCT/KR2022/007579, filed on May 27, 2022, which claims priority under 35 U.S.C. 119 (a) to Patent Application No. 10-2022-0010793, filed in the Republic of Korea on Jan. 25, 2022, all of which are hereby expressly incorporated by reference into the present application.

FIELD

The present disclosure is a technology related to a method and device that provides guide information after washing has been completed.

DESCRIPTION OF RELATED ART

Conventionally, a washing apparatus output a notification sound when washing has been completed so that the user may confirm the completion of washing. However, a situation may arise where the user does not hear the washing end notification sound or cannot check the end of washing due to performing other tasks.

However, when the laundry has been left in a neglected manner in the washing apparatus after the laundry washing has been finished, the laundry that is not completely dried may produce an unpleasant odor. Thus, a rinsing-dehydration process may be repeated.

Therefore, technology is needed to prevent laundry from being left in a neglected manner to create bad smell in the washing tub after washing has been completed.

DISCLOSURE

Technical Purpose

A purpose of the present disclosure is to solve the above-mentioned problem and is to provide guide information after the end of washing based on an analyzing result of a time duration elapsed from the end of washing of the washing apparatus to an operation start of a drying apparatus.

A purpose of the present disclosure is to provide guide information after washing has been completed based on information on a time duration which has elapsed such that odor is produced from the laundry while the laundry has been left in a neglected manner, various external environments, and users' usage habits.

A purpose of the present disclosure is to provide guide information in a case where a washing apparatus lid is opened, and the user does not collect the laundry.

Purposes according to the present disclosure are not limited to the above-mentioned purpose. Other purposes and advantages according to the present disclosure that are not mentioned may be understood based on following descriptions, and may be more clearly understood based on embodiments according to the present disclosure. Further, it will be easily understood that the purposes and advantages according to the present disclosure may be realized using means shown in the claims or combinations thereof.

Technical Solution

A method for providing guide information after completion of washing according to one embodiment of the present disclosure includes receiving, by a server communication unit of a management server, a first message notifying an end of washing of laundry from the washing apparatus washing the laundry; receiving, by the server communication unit, a second message notifying a start of drying from a drying apparatus to dry the laundry of the washing apparatus; calculating, by a server controller of the management server, a time duration for which the laundry has been left in a neglected manner in the washing apparatus, based on the first message and the second message; comparing, by the server controller of the management server, the time duration for which the laundry has been left in a neglected manner in the washing apparatus with a reference time duration; and controlling, by the server controller of the management server, a notification process to the washing apparatus or the drying apparatus, based on the comparing result.

A management server for providing guide information after completion of washing according to another embodiment of the present disclosure includes a server communication unit configured to receive a first message notifying an end of washing of laundry from the washing apparatus washing the laundry, and to receive a second message notifying a start of drying from a drying apparatus to dry the laundry of the washing apparatus; and a server controller configured to: calculate a time duration for which the laundry has been left in a neglected manner in the washing apparatus, based on the first message and the second message; compare the time duration for which the laundry has been left in a neglected manner in the washing apparatus with a reference time duration; and control a notification process to the washing apparatus or the drying apparatus, based on the comparing result.

Technical Effect

According to the present disclosure, the time duration elapsed from the end of washing of the washing apparatus to an operation start of the drying apparatus may be analyzed and the guide information after the end of washing may be provided based on the analysis result.

Furthermore, according to the present disclosure, the guide information after washing has been completed may be provided based on information on the time duration which has elapsed while the laundry has been left in a neglected manner such that odors are generated from the laundry, various external environments, and users' usage habits.

Furthermore, according to the present disclosure, the guide information may be provided in a case where a washing apparatus lid is opened, and the user does not collect the laundry.

The effects of the present disclosure are not limited to the effects described above, and those skilled in the art of the present disclosure may easily derive various effects of the present disclosure from the configuration of the present disclosure.

BRIEF DESCRIPTION OF DRAWINGS

FIG. 1 is a diagram showing a process and a configuration of apparatuses in which a server prevents laundry from being left in a neglected manner in response to an operation of the washing apparatus according to an embodiment of the present disclosure.

FIG. 2 is a diagram showing a process of providing voice guidance to cope with a state in which the laundry has been left in a neglected manner according to an embodiment of the present disclosure.

FIG. 3 is a diagram showing a process and a configuration of apparatuses in which a management server creates a message for voice guidance and transmits the message to each of the apparatuses according to an embodiment of the present disclosure.

FIG. 4 is a block diagram showing a schematic configuration of the management server 300 according to an embodiment of the present disclosure.

FIG. 5 is a block diagram showing a schematic configuration of a user terminal according to an embodiment of the present disclosure.

FIG. 6 is a diagram showing a process in which the management server calculates a reference time duration to be compared with a time duration for which the laundry has been left in a neglected manner in the washing apparatus according to one embodiment of the present disclosure.

FIG. 7 is a diagram showing a process in which the management server applies laundry and laundry washing course information to a process of estimating the time duration for which the laundry has been left in a neglected manner according to one embodiment of the present disclosure.

FIG. 8 is a diagram showing a process in which the management server creates a message based on the user's habits or past behavior according to an embodiment of the present disclosure.

FIG. 9 is a diagram showing a comment output process when there is a rinse course between completion of the washing and start of drying according to an embodiment of the present disclosure.

DETAILED DESCRIPTIONS

Hereinafter, with reference to the drawings, embodiments of the present disclosure will be described in detail so that those skilled in the art in the technical field to which the present disclosure belongs may easily implement the present disclosure. The present disclosure may be implemented in several different forms and is not limited to the embodiments described herein.

In order to clearly describe the present disclosure, parts not related to the description are omitted, and identical or similar elements are given the same reference sign throughout the present disclosure. Furthermore, some embodiments of the present disclosure are described in detail with reference to illustrative drawings. In adding reference numerals to components in the drawings, identical components may have the same reference numerals as much as possible even when they are shown in different drawings. Furthermore, when describing the present disclosure, when it is determined that a detailed description of a structure or a function well known to the skilled person to the art may obscure the gist of the present disclosure, the detailed description thereof may be omitted.

When describing the components of the present disclosure, terms such as first, second, A, B, a, and b may be used. These terms are only used to distinguish one component from another component, and the nature, sequence, order, or number of the component are not limited by the term. It should be understood that when a component is described as being "connected," "coupled," or "combined" to another component, the component may be directly connected, coupled, or combined to another component, still another component may be "interposed" therebetween, and thus the component may be connected, coupled, or combined to another component via the sill another component.

Furthermore, when implementing the present disclosure, a component may be subdivided into sub-components for convenience of description. However, components may be integrated into a single apparatus or module. One component may be distributed in multiple apparatuses or modules.

Hereinafter, a method and device for providing guide information after washing has been completed will be described.

FIG. 1 is a diagram showing a process and a configuration of apparatuses in which a server prevents laundry from being left in a neglected manner in response to an operation of a washing apparatus according to an embodiment of the present disclosure.

Each of a washing apparatus 100 and a drying apparatus 200 communicates with a management server 300. Each of the washing apparatus 100 and the drying apparatus 200 may transmit information (start time, end time, performed function, etc.) about an operation thereof to the management server 300, and the information is stored in the management server 300 in S1 and S2.

Then, the management server 300 analyzes an operation history of the washing apparatus 100 or the drying apparatus 200 and controls a voice server 400 to output a voice comment including information (guide information) to be informed to the user to each of the washing apparatus 100 and the drying apparatus 200, based on the analyzing result in S3.

In addition, the management server 300 may transmit information to be notified to the user to the user terminal 500 in a pushing message form in S7. In this regard, a user terminal 500 is a terminal owned by the user who owns or uses the washing apparatus 100 and the drying apparatus 200, and the user terminal 500 is linked to the washing apparatus 100 and the drying apparatus 200 via the management server 300.

The voice server 400 transmits a product voice notification sound source to the washing apparatus 100 or the drying apparatus 200 in S8 and S9. The user may check the sound source output from the washing apparatus 100 or the drying apparatus 200.

The management server 300 and the voice server 400 may be integrated into a single server. That is, one integrated server 700 may provide both the functions of the management server 300 and the functions of the voice server 400. Based on the configuration in FIG. 1, the management server 300 obtains a time duration elapsed from the end of washing of the washing apparatus to an operation start of the drying apparatus based on the received information in S1 and S2.

Based on the result of analyzing the data received in S1 and S2, the management server 300 provides a product voice notification based on the customer's behavioral characteristics of the customer in S8 and S9 or sends the pushing message to an application of the user terminal 500 to allow the user to check the message.

The washing apparatus 100 or the drying apparatus 200 transmits the usage information thereof to the management server 300. The management server 300 stores the usage information therein and calculates a time duration for which the laundry has been left in a neglected manner in the washing apparatus after the end of washing. Then, the management server 300 stores information on the calculated time duration for which the laundry has been left in a neglected manner in the washing apparatus based on each user into a monitoring DB.

Based on the stored monitoring history information, the management server 300 provides a notification service of the time duration for which the laundry has been left in a neglected manner in the washing apparatus based on each user, such that the user may reduce a consumed time duration corresponding to the time duration for which the laundry has been left in a neglected manner in the washing apparatus. This prevents a situation where the user does not take out the laundry from the washing apparatus immediately after the end of washing such that the laundry emits unpleasant odor and thus should be washed again.

A combination of S3, S8, and S9 is a process in which the management server 300 is associated with the voice server 400 to control a notification process of the washing apparatus 100 or the drying apparatus 200.

FIG. 2 is a diagram showing a process of providing voice guidance to cope with a state in which the laundry has been left in a neglected manner according to an embodiment of the present disclosure. The washing apparatus 100 starts washing in S11. Afterwards, when washing has been finished, the washing apparatus 100 notifies the management server 300 of the end of the washing in S1, and the management server 300 accordingly stores therein the washing end time of the washing apparatus 100 in S12.

Afterwards, when the drying apparatus 200 starts drying, the drying apparatus 200 notifies the management server 300 of the start of the drying in S2, and accordingly, the management server 300 stores therein the drying start time of the drying apparatus 200 in S13.

The management server 300 calculates a time duration from the washing end time of the washing apparatus 100 to the drying start time of the drying apparatus 200 and thus define the calculated time duration as the time duration (T_neg) for which the laundry has been left in a neglected manner in the washing apparatus 100 in S14. Then, when the time duration (T_neg) for which the laundry has been left in a neglected manner in the washing apparatus is larger than a reference time duration (for example, 1 hour or a specific reference time duration), the management server 300 provides a guidance service related to a situation in which the laundry has been left in a neglected manner in the washing apparatus in S16. For example, a voice guidance message is delivered to the washing apparatus 100 and the drying apparatus 200 by the management server 300 and the voice server 400, so that the user may check the voice guidance message.

When the time duration for which the laundry has been left in a neglected manner in the washing apparatus is smaller than or equal to the reference time duration in S14, no guidance may be provided in S15.

In an embodiment of the present disclosure, the management server 300 may flexibly set the reference time duration depending on the season, temperature, weather, etc. In dry seasons (fall, winter, or sunny days, etc.), the management server 300 may increase the reference time duration. The management server 300 may increase the reference time duration based on the characteristics of laundry which does not quickly release odor even when the laundry has been left in a neglected manner in dry weather or environments.

Conversely, in a humid season (summer, rainy season, etc.), the management server 300 may decrease the reference time duration. The management server 300 may reduce the reference time duration based on the characteristic of laundry that quickly smells when the laundry has been left in a neglected manner in humid weather or environments.

The management server 300 may increase or decrease the reference time duration using weather information, humidity information, temperature information, etc. of an area where the washing apparatus 100 and the drying apparatus 200 are placed. Furthermore, the reference time duration may be increased or decreased based on each user. When the time duration for which the laundry has been left in a neglected manner in the washing apparatus increases, compared to the user's existing record of the time duration for which the laundry has been left in a neglected manner in the washing apparatus, the management server 300 may provide a guidance message.

An embodiment of FIG. 2 may be applied as follows. The management server 300 collects and stores therein the washing end time information and the drying start time information respectively transmitted from the washing apparatus 100 and the drying apparatus 200 of each user. Then, the management server 300 may analyze the time duration elapsed from the end of washing of the washing apparatus 100 to an operation start of the drying apparatus 200.

When it is identified based on a result of the analysis that the number of users who correspond to a critical point of the number of all users or account for a certain percentage (20%, 40%, etc.) of all users have the time duration for which the laundry has been left in a neglected manner in the washing apparatus larger than or equal to n minutes (for example, 60 minutes), the management server 300 may set the n minutes as the reference time duration. Alternatively, the management server 300 may set n minutes depending on the weather and humidity conditions, characteristics of the day (weekdays/weekends), whether it is a public holiday, etc.

The management server 300 may calculate the n minutes based on information on the time duration which has elapsed while the laundry has been left in a neglected manner such that unpleasant odor is produced from the laundry, various external environments, and users' usage habits. Then, the management server 300 and the voice server 400 transmit a voice guidance message appropriate to the user's behavior based on each user who neglects the laundry.

When the embodiment of FIG. 2 is applied, different pushing messages and voice guidance messages (guide information) may be transmitted or output to different users. The management server 300 and the voice server 400 may transmit a product voice notification or a pushing message providing guide information on a laundry management recipe based on the behavioral characteristics of each user to each of the washing apparatus 100, the drying apparatus 200, and the user terminal 500. The above-described notification/pushing message may allow the user may reduce the time duration for which the laundry has been left in a neglected manner and ensure that the laundry is dried into a pleasant state after finishing the washing. Furthermore, when applying the above-described embodiment, a situation where the laundry has been left in a neglected manner and thus the laundry is washed again after the washing may be prevented.

Furthermore, when applying the above-described embodiment, the management server 300 may calculate the time duration for which the laundry has been left in a neglected manner without the need to place a physical sensor for sensing an operating state inside the washing apparatus (e.g., opening laundry tub, taking out laundry, etc.) and may calculate more accurately the time duration for which the laundry has been left in a neglected manner FIG. 3 is a diagram showing a process and a configuration of the apparatuses in which the management server creates a message for voice guidance and transmits the message to each of the apparatuses according to an embodiment of the present disclosure.

S1, S2, and S7 are the same as those in FIG. 1 as described above. Thus, the descriptions about S1, S2, and S7 refer to the descriptions of FIG. 1.

Based on the result of analyzing the data received in S1 and S2, the management server 300 creates the voice guidance notification message in consideration of the behavioral characteristics of each customer to be transmitted to the washing apparatus 100 and the drying apparatus 200. Then, the management server 300 transmits the notification message to the washing apparatus 100 and the drying apparatus 200 in S18 and S19.

The notification message may be one of 1) a message composed of a text or 2) a message including a sound source. When the notification message is a text message, the washing apparatus 100 and the drying apparatus 200 having received the text message may convert the text message into a sound source using an internal user interface and output the sound source, or may output the text of the text message on a display.

When the notification message includes the sound source file, the washing apparatus 100 and the drying apparatus 200 having received the sound source file may output the sound source using the internal user interface.

As in FIG. 1, the server 300 sends the pushing message to the application of the user terminal 500 in S7 so that the user may check the pushing message. The pushing message is kind of the notification message and includes examples as a text, a sound source, etc.

A combination of S18 and S19 is a process in which the management server 300 alone controls the notification process to the washing apparatus 100 or the drying apparatus 200.

FIG. 4 is a block diagram showing a schematic configuration of the management server 300 according to an embodiment of the present disclosure. The management server 300 may be abbreviated as a server.

Referring to FIG. 4, the management server 300 may include a server communication unit 310, a server controller 320, and server storage 333.

The server communication unit 310 may communicate with the washing apparatus 100, the drying apparatus 200, and the user terminal 500. The server communication unit 310 may perform communication in a wired scheme and/or a wireless scheme. The wireless scheme may include a short-range wireless communication scheme and a long-distance wireless communication scheme.

The server controller 320 may control the server communication unit 310 and the server storage 330.

Although not shown in the drawing, the server controller 320 may include a processor and an internal memory. The internal memory may store therein a server application for managing the washing apparatus 100, and the drying apparatus 200. The processor may execute the server application.

The server storage 330 may be a volatile and/or non-volatile memory, and may store therein the message transmitted from the washing apparatus 100, the drying apparatus 200, etc. The message includes a performed function, a washing course, a drying course, or a start time and a completion time of each function as performed by each of the washing apparatus 100, the drying apparatus 200, etc. Furthermore, information about an error or an abnormal state that occurs during the performance of each function may also be included in the above-described message.

Furthermore, the message transmitted from the washing apparatus 100, the drying apparatus 200, etc. include identification information of each of the washing apparatus 100 and the drying apparatus 200.

The server controller 320 creates a notification message to be transmitted to the washing apparatus 100, the drying apparatus 200, etc. When the created notification message is transmitted to the washing apparatus 100 and the drying apparatus 200, the speaker or the LCD display in each of the washing apparatus 100 and the drying apparatus 200 may output the message in a voice or text manner.

Alternatively, the notification message may include a form of a sound source file. In this case, the washing apparatus 100, the drying apparatus 200, etc. may play the sound source file included in the notification message to provide the voice guidance to the user.

Furthermore, the server controller 320 may check an operating status of each of the washing apparatus 100 and the drying apparatus 200. The server controller 320 may check the operating status thereof by checking a status message periodically transmitted from each of the washing apparatus 100 and the drying apparatus 200, or by checking whether communication with each of the washing apparatus 100 and the drying apparatus 200 is maintained.

Then, the server communication unit 310 may transmit a message (guide information, etc.) to the user terminal 500 to instruct the user terminal 500 to control the washing apparatus 100 and the drying apparatus 200 or to control the operating status or the function of each of the washing apparatus 100 and the drying apparatus 200.

The server storage 330 may store therein a history of a time duration for which the laundry has been left in a neglected manner in the washing apparatus as calculated based on information about the end of washing and the start of drying as previously transmitted from a plurality of washing apparatuses and a plurality of drying apparatuses. Furthermore, the server storage 330 may store therein the reference time duration adjusted based on humidity, temperature, weather, etc. of each region. Furthermore, the server storage 330 may store therein information (a rate, k minutes) used to partially increase or decrease the time duration for which the laundry has been left in a neglected manner in the washing apparatus as a comparing target, depending on the humidity, temperature, weather, etc. of each region.

The configuration of FIG. 4 may be applied to an embodiment of FIG. 1 as follows.

The server communication unit 310 of the management server 300 receives a first message notifying the end of washing from the washing apparatus 100 in S1. Then, the server communication unit 310 receives a second message notifying the start of drying from the drying apparatus 200 that dries the laundry of the washing apparatus in S2. The server storage 330 stores therein the first and second messages. In this regard, the washing apparatus 100 and the drying apparatus 200 are placed in the same space to provide a washing-drying service.

The server controller 320 of the management server 300 calculates the time duration for which the laundry in the washing apparatus has been left in a neglected manner in the washing apparatus using the first message and the second message. The server controller 320 of the management server 300 compares the time duration for which the laundry has been left in a neglected manner in the washing apparatus with the reference time duration. Based on the comparing result, the server controller 320 creates a request message requesting that the washing apparatus 100 or the drying apparatus 200 output a sound source and sends the request message to the sound source server 400 in S3. The request message includes contents (comment) to be output as a sound source.

Then, the sound source server 400 creates the sound source file based on the request message and transmits a notification message including the sound source file to at least one of the washing apparatus 100 or the drying apparatus 200 in S8 and S9.

The configuration of FIG. 4 may be applied to an embodiment of FIG. 3 as follows.

The server communication unit 310 of the management server 300 receives the first message notifying the end of washing from the washing apparatus 100 in S1. Then, the server communication unit 310 receives the second message notifying the start of the drying from the drying apparatus 200 that dries the laundry of the washing apparatus in S2. In this regard, the washing apparatus 100 and the drying apparatus 200 are placed in the same space to provide a washing-drying service.

The server controller 320 of the management server 300 calculates the time duration for which the laundry in the washing apparatus has been left in a neglected manner in the washing apparatus using the first message and the second message. The server controller 320 of the management server 300 compares the time duration for which the laundry has been left in a neglected manner in the washing apparatus with the reference time duration. Based on the comparing result, the server controller 320 creates a notification message to be transmitted to the washing apparatus 100 or the drying apparatus 200.

The server communication unit 310 transmits the created notification message to at least one of the washing apparatus 100 or the drying apparatus 200 in S18 and S19. In this case, the notification message may include a sound source file that the washing apparatus or the drying apparatus may output.

Furthermore, the server controller 320 creates the pushing message to be transmitted to the user terminal 500 linked to the washing apparatus and the drying apparatus. The server communication unit 310 may transmit the pushing message to the user terminal 500 in S7.

FIG. 5 is a block diagram showing a schematic configuration of a user terminal according to an embodiment of the present disclosure. The user terminal 500 may be referred to as a client device, etc.

Referring to FIG. 5, the user terminal 500 may include a terminal communication unit 510, a terminal controller 520, and a terminal interface 530. The user terminal 500 may be linked with the washing apparatus 100 and the drying apparatus 200, so that the user terminal 500 may check a current status of each of the washing apparatus 100 and the drying apparatus 200.

The terminal communication unit 510 may communicate with the management server 300. The terminal communication unit 510 may perform communication in a wired scheme and/or a wireless scheme. The wireless scheme may include a short-range wireless communication scheme and a long-distance wireless communication scheme.

The terminal controller 520 may control the terminal communication unit 510 and the terminal interface 530.

Although not shown in the drawing, the terminal controller 520 may include a processor and an internal memory. The internal memory may store therein a terminal application for managing the washing apparatus 100 and the drying apparatus 200. The processor may execute the terminal application.

The terminal interface 530 may output an execution screen of the terminal application. In particular, the terminal interface 530 may output information related to the performance of the function of each of the washing apparatus 100 and the drying apparatus 200 visually and/or audibly.

The terminal communication unit 510 may transmit and receive the message to and from the management server 500. Additionally, the terminal communication unit 510 may receive status information of the washing apparatus 100 and the drying apparatus 200 linked to the user terminal from the management server 300.

In the process of communicating with the management server 300, the user terminal 500 linked to the washing apparatus 100 and the drying apparatus 200 may receive a notification message for guidance related to the time duration for which the laundry has been left in a neglected manner in the washing apparatus from the management server 300. In this regard, the user terminal 500 may receive the notification message as the pushing message and output the pushing message in a form of a pop-up.

After the terminal interface 530 outputs the notification message, the terminal communication unit 510 may transmit a result of whether the user has checked the message to the management server 300.

FIG. 6 is a diagram showing a process in which the management server calculates the reference time duration to be compared with the time duration for which the laundry has been left in a neglected manner in the washing apparatus, according to an embodiment of the present disclosure.

The server communication unit 310 collects regional humidity information and temperature information in S21. The weather information may also be included in the collected regional humidity information and temperature information. The present disclosure includes an embodiment in which the server communication unit 310 receives weather information of each region according to a predefined reception reference (every day/morning, afternoon/hourly, etc.).

Then, the server controller 320 calculates the reference time duration of each region based on the humidity information and temperature information and stores the calculated reference time duration in the server storage 330 in S22. For example, the server controller 320 may calculate the reference time duration of each of Seoul and Gangwondo as each administrative district. More specifically, the reference time duration may be about a smaller administrative district of the regional range, such as the reference time duration of Seoul-Jongnogu or the reference time duration of Gangwondo-Pyeongchang.

Afterwards, the server controller 320 calculates the time duration for which the laundry has been left in a neglected manner in the washing apparatus based on the messages sent from the washing apparatus and the drying apparatus. Then, the server controller 320 reads the reference time duration of each region where the washing apparatus and the drying apparatus are placed from the server storage 330. That is, the server controller 320 compares the reference time duration of the region in which the washing apparatus is placed as stored in the server storage 330 with the time duration for which the laundry has been left in a neglected manner in the washing apparatus in S23.

As a result, the server controller 320 may create a notification message or a request message to notify the customer about a state in which the laundry has been left in a neglected manner in S24. The notification message is transmitted to the washing apparatus/drying apparatus. The request message is transmitted to the voice server 400. Thus, the voice server 400 transmits the notification message including the sound source file to the washing apparatus/drying apparatus. Furthermore, the management server 300 may transmit the notification message to the user terminal 500.

An embodiment of FIG. 6 is applied as follows. Based on the humidity in the region in which the washing apparatus/drying apparatus have been placed, the reference time duration to be compared to the time duration for which the laundry has been left in a neglected manner in the washing apparatus may be increased or decreased. For example, the server controller 320 may set the reference time duration to be smaller (for example, 50 minutes) based on the high humidity of a rainy area or a beach area in the summer. Conversely, the server controller 320 may set the reference time duration to be larger (for example, 70 minutes) based on the low humidity of the dry area.

FIG. 6 presents an example in which the server controller 320 sets the reference time duration to vary depending on humidity, temperature, weather, etc. To achieve the same technical purpose, the server controller 320 may fix the reference time duration but increase or decrease the time duration for which the laundry has been left in a neglected manner in the washing apparatus by a certain percentage.

In one example, the reference time duration may be fixed to 1 hour. The actual time duration for which the laundry has been left in a neglected manner in the washing apparatus may be 1 hour. In this case, the server controller 320 may multiply, by 1.1 times, the time duration for which the laundry has been left in a neglected manner in the washing apparatus, based on the high humidity, thereby obtaining the adjusted left time duration of the laundry. Thus, although the actual left time duration of the laundry 1 hour, the server controller 320 may adjust the left time duration of the laundry to 66 minutes based on high humidity, and may compare the 66 minutes as the adjusted left time duration to the reference time duration of 1 hour, and thus, may determine that the time duration for which the laundry has been left in a neglected manner in the washing apparatus exceeds the reference time duration.

Conversely, the server controller 320 may multiply, by 0.9 times, the time duration for which the laundry has been left in a neglected manner in the washing apparatus, based on the low humidity of dry areas, thereby obtaining the adjusted left time duration of the laundry. Thus, although the actual left time duration of the laundry 1 hour, the server controller 320 may adjust the left time duration of the laundry to 54 minutes based on the low humidity, and may compare the 54 minutes as the adjusted left time duration to the reference time duration of 1 hour, and thus, may determine that the time duration for which the laundry has been left in a neglected manner in the washing apparatus does not exceed the reference time duration.

In an embodiment of FIG. 6, when the time duration for which the laundry has been left in a neglected manner in the washing apparatus exceeds the reference time duration, the server controller 320 includes a guidance message such as "It will rain in the OO area today and quick drying is necessary" or "The humidity in summer is high and thus quick drying is required" into the notification message or the request message in S24. The notification message is transmitted to the washing apparatus/drying apparatus. The request message is transmitted to the voice server 400. The voice server 400 transmits the notification message including the sound source file to the washing apparatus/drying apparatus.

In summary, the server controller 320 calculates the reference time duration using local humidity information and temperature information and stores the calculated reference time duration in the server storage 330. Then, the server controller 320 controls the notification process to the washing apparatus/drying apparatus based on a comparing result of the time duration for which the laundry has been left in a neglected manner in the washing apparatus with the reference time duration stored in the server storage 330.

FIG. 7 is a diagram showing a process in which the management server applies laundry and laundry washing course information to a process of estimating the time duration for which the laundry has been left in a neglected manner according to one embodiment of the present disclosure.

The server communication unit 310 receives a washing information message including information about the laundry or a laundry washing course from the washing apparatus 100, or receives a first message (a message notifying the end of washing) including washing information in S31.

The server controller 320 calculates a moisture content ratio of the laundry using the information about the laundry and the laundry washing course in S32. For example, the washing information may include information about a blanket washing course. In this case, the server controller 320 may determine that the moisture content ratio of the laundry is high due to the nature of the blanket.

For example, the washing information may include information about an wrinkle-free washing course. In this case, the server controller 320 may determine that the moisture content ratio of the laundry is high due to the characteristics of the wrinkle-free washing.

The server controller 320 may determine the moisture content ratio in relation to the washing course or the laundry type and adjust the comparison result of the time duration for which the laundry has been left in a neglected manner in the washing apparatus with the reference time duration based on the determined moisture content ratio in S33. For example, since in the blanket washing course or the wrinkle-free washing course, the laundry contains a large amount of moisture, the server controller 320 may adjust the time duration for which the laundry has been left in a neglected manner in the washing apparatus to be increased or may adjust the reference time duration to be decreased.

When the time duration for which the laundry has been left in a neglected manner in the washing apparatus exceeds the reference time duration, the server controller 320 may include the guidance message such as "Quick drying of blanket laundry is required" or "Quick drying is required in the wrinkle-free washing mode" into the notification message or request message in S34. The notification message is transmitted to the washing apparatus/drying apparatus. The request message is transmitted to the voice server 400. The voice server 400 transmits the notification message including the sound source file to the washing apparatus/drying apparatus. Furthermore, the management server 300 may transmit the notification message to the user terminal 500.

FIG. 8 is a diagram showing a process in which the management server creates a message based on the user's habits or past behaviors according to an embodiment of the present disclosure.

The server controller 320 stores information about the end of washing and the start of drying as transmitted from a plurality of washing apparatuses/drying apparatuses or a history of the time duration for which the laundry has been left in a neglected manner in the washing apparatus in the server storage 330 in S41. The server controller 320 may store the first message/second message transmitted from the washing apparatus/drying apparatus in the server storage 330 cumulatively.

Alternatively, the server controller 320 may extract the time duration for which the laundry has been left in a neglected manner in the washing apparatus from the first message/second message transmitted from the washing apparatus/drying apparatus and store the extracted time duration in the server storage 330. Furthermore, the server controller 320 may store, in the server storage 330, feature information of the date or the time in relation to the time duration for which the laundry has been left in a neglected manner in the washing apparatus. For example, the server controller 320 may store, in the server storage 330, information about whether it is a weekend or a public holiday along with the time duration for which the laundry has been left in a neglected manner in the washing apparatus.

Afterwards, upon receiving the first message/second message from specific washing apparatus/drying apparatus, the server controller 320 adjusts the time duration for which the laundry has been left in a neglected manner in the washing apparatus, or the reference time duration, based on the history of the time duration for which the laundry has been left in a neglected manner in the washing apparatus as stored in the server storage 330 in S42. The history of the time duration for which the laundry has been left in a neglected manner in the washing apparatus refers to a previous record of the time duration for which the laundry has been left in a neglected manner in the washing apparatus or the drying apparatus. Furthermore, this record may be deleted periodically. Alternatively, the server controller 320 lowers a weight assigned to a past record so that the reference time duration or the time duration for which the laundry has been left in a neglected manner in the washing apparatus may be adjusted based on a recent record related to the washing apparatus or the drying apparatus.

Then, the server controller creates a notification message or a request message that includes a comment notifying the increase or decrease in the time duration for which the laundry has been left in a neglected manner in the washing apparatus in S43.

For example, when the user left the laundry in the washing apparatus in the neglected manner for 2 hours in the past, but left the laundry in the washing apparatus in the neglected manner for about 1 hour and 5 minutes recently, the server controller 320 may determine that the time duration for which the laundry has been left in a neglected manner in the washing apparatus will not exceed the reference time duration. Alternatively, the server controller 320 may create a notification message/request message including a message indicating that the time duration for which the laundry has been left in a neglected manner in the washing apparatus is gradually decreasing and thus the method of the present disclosure is effective.

Furthermore, when the time duration for which the laundry has been left in a neglected manner in the washing apparatus gradually increases, the server controller 320 may again provide, to the user, the guidance regarding the time duration for which the laundry has been left in a neglected manner in the washing apparatus. For example, the user left the laundry in the washing apparatus in the neglected manner for 20 minutes in the past, but left the laundry in the washing apparatus in the neglected manner for about 50 minutes recently. In this case, although the about 50 minutes is smaller than the reference time duration of 1 hour, there is a possibility that the time duration for which the user has left the laundry in a neglected manner in the washing apparatus will exceed the reference time duration of 1 hour in the future. Therefore, the server controller 320 may create a notification message/request message that includes a comment encouraging an action to reduce the time duration for which the laundry has been left in a neglected manner in the washing apparatus, such as "Recently, the time duration which the laundry has been left in a neglected manner in the washing apparatus is increasing. Please dry it quickly."

Afterwards, the management server 300 transmits the notification message to the washing apparatus/drying apparatus, and transmits the request message to the voice server 400 in S44. Upon receiving the request message, the voice server 400 transmits the notification message including the sound source file to the washing apparatus/drying apparatus. Furthermore, the management server 300 may transmit the notification message to the user terminal 500.

An embodiment of FIG. 8 may be applied as follows. When the time duration for which the laundry has been left in a neglected manner in the washing apparatus has increased or decreased in the previous history of the time duration for which the laundry has been left in a neglected manner in the washing apparatus, the server controller may control the notification process such that the comment indicating the increase or decrease in the time duration for which the laundry has been left in a neglected manner in the washing apparatus may be output from the washing apparatus/drying apparatus, etc. As a result, the user may recognize the habit thereof of leaving the laundry in a neglected manner and correct the habit.

When the embodiment of FIG. 8 is applied, the management server 300 continuously monitors the time duration elapsed between the finishing time of the washing and the start time of the drying of the laundry in the drying apparatus, and checks the reduction in the elapsed time duration, and reports the reduction to the user. As a result, the washing apparatus/drying apparatus may output a message through voice or text, such as "Customer, the time duration elapsed between the end of the washing and an operation start of the drying apparatus is getting smaller. Doesn't the laundry smell anymore?" This message may be displayed on the display of the user terminal 500.

When the embodiment of FIG. 8 is applied, the management server 300 monitors the elapsed time duration based on the external environment (time, weather, etc.). When the elapsed time duration in a specific environment is large, the management server 300 may notify the information about the specific environment to the user. As a result, the washing apparatus/drying apparatus outputs a message in a voice or text form such as "Customer, when you do laundry on the weekend, the time duration elapsed from the end of the washing to an operation start of the drying apparatus exceeds 1 hour. Please take out the laundry a little early on the weekend." This message may be displayed on the display of the user terminal 500.

FIG. 9 is a diagram showing a comment output process in a situation in which there is a rinse course between the completion of the washing and the start of the drying according to an embodiment of the present disclosure.

The server controller 320 of the management server 300 may determine whether, after the washing has been finished but before the drying apparatus starts drying, the washing apparatus performs new washing. For example, the server communication unit 320 receives a first message notifying the end of the washing from the washing apparatus 100.

Then, the management server 300 receives a third message related to performing of the washing function from the washing apparatus 100 before receiving the second message notifying the start of drying from the drying apparatus 200. This is intended to cope with a case where the laundry of the washing apparatus 100 has been left in a neglected manner in the washing apparatus for a long time and thus the rinse cycle should be performed again. More specifically, the third message may include information about performing of the rinse cycle of the washing apparatus.

In this case, the server controller 320 controls the notification process to include therein re-rinse course execution guidance message due to neglect of the laundry. For example, the management server 300 compares a reception time of the first message and a reception time of the second message with each other. When the time duration elapsed between the reception time of the first message and the reception time of the second message is larger, by at least k times, than the reference time duration, the server controller may create a request message or a notification message to include therein a message guiding the execution of the re-rinse course due to neglect of the laundry.

Reference to 51 in FIG. 9 will be made. The management server 300 identifies that it takes 3 hours from the completion of washing (1:30 p.m.) to the start of drying (4:30 p.m.), and the rinsing course is executed at a time therebetween (4:10 p.m.). In this regard, the reference time duration is 1 hour and the aforementioned k value is 2.5. This is one example.

In this case, it takes 20 minutes from the end of the intermediate rinsing course to the start of the drying. It takes 3 hours from the completing of the washing to start of the drying. Therefore, in this case, the time duration of the laundry has been left in a neglected manner in the washing apparatus is 3 hours compared to the reference time duration of 1 hour, and the 3 hours exceeds 2.5 times over reference time. Thus, the management server 300 may create a notification/request message to include therein a comment such as "Re-rinsing was executed due to neglect of laundry. Please take out the laundry a little quickly."

In another embodiment, the management server 300 may determine whether to output a guidance message based on the time duration elapsed between the completion time of the rinsing course and the start time of drying and the time duration elapsed between the completion time of the rinse course and the completion time of the washing, and accordingly, may or may not create the notification/request message.

Reference to 52 in FIG. 9 will be made. The management server 300 identifies that it takes 1.5 hours from the completion of washing (1:30 p.m.) to the start of drying (3:00 p.m.), and the rinsing course is executed at a time therebetween (2:15 p.m.).

In this case, it takes 45 minutes from the completing of the washing to the end of the intermediate rinsing course. It takes 45 minutes from the end of the intermediate rinsing course to the start of the drying. In other words, the time duration of 45 minutes between completion of washing and the middle rinsing course is smaller than the reference time duration of 1 hour. The time duration of 45 minutes between from the completion of the rinsing course and the start of drying is also smaller than the reference time duration of 1 hour.

In this case, the management server 300 prevents a separate information message from being output. In this case, it is less likely that the user leaves the laundry in a neglected manner for a long time.

When the above-described embodiment is applied, the management server 300 may determine whether the laundry has been left in a neglected manner based on the washing end time of the washing apparatus and the drying start time of the drying apparatus and may provide the guide information to the washing apparatus/drying apparatus/user terminal based on the determination result.

In particular, there are many cases where users do not collect the laundry after opening the washing apparatus lid, and leave the lid in the open state. However, according to the embodiment of the present disclosure, the management server may provide guide information based on a checking result of the operation start time of the drying apparatus.

The management server 300 may set the reference time duration to be compared with the time duration for which the laundry has been left in a neglected manner in order to determine whether to provide guide information, under various situations. When a certain percentage of the number of users leave the laundry in a neglected manner for more than 1 hour after the end of the washing, the reference time duration may be set to 1 hour. Furthermore, the management server 300 may calculate the time duration for which the laundry has been left in a neglected manner and the reference time duration related the laundry's generating unpleasant odor based on seasonal factors and environmental factors, and the management server 300 may determine whether to provide guide information based on the calculation.

Furthermore, the management server 300 may cumulatively store users' washing apparatus/drying apparatus usage patterns and may determine the users' behavioral characteristics based on the usage patterns and may provide guide information based on the users' behavioral characteristics. As a result, users may receive the guide information appropriate for individual situations, rather than the constant pushing message or guide information.

To this end, the management server 300 may store and monitor the user' product usage information of the washing apparatus and the drying apparatus in the server storage 330. Thus, the guide information provided to the user may be personalized based on the stored history information. In particular, the management server 300 continuously monitors the time duration for which the user has left the laundry in a neglected manner in the washing apparatus, confirms the reduction in the monitored time duration, and guides the user so that the user may more actively reduce the time duration for which the laundry has been left in a neglected manner in the washing apparatus.

As described above with reference to FIG. 6 to FIG. 9, the management server 300 monitors the time duration for which the user has left the laundry in a neglected manner in the washing apparatus, based on the external environment (time, weather, etc.). When the monitored time duration is large in a specific environment, the management server 300 report the specific environment to the user.

An embodiment of the present disclosure in which all the components are combined with each other or operate in combination with each other has been described. However, the present disclosure is not necessarily limited to this embodiment. Within the scope of the purpose of the present disclosure, at least two of all components may be selectively combined with other or may operate in the selectively combined manner with other. Furthermore, each of the components may be implemented as an independent hardware. However, some or all of the components may be selectively combined with each other and thus may be implemented using a computer program with a program module to perform some or all of the functions combined in one or more pieces of hardware. The codes and code segments that constitute the computer program may be easily deduced by a person skilled in the art from the present disclosure. The computer program may be stored in computer readable media and read and executed by a computer, thereby implementing the method of the present disclosure. The storage media for storing the computer program may include storage media including magnetic recording media, optical recording media, and semiconductor recording devices. Additionally, the computer program implementing an embodiment of the present disclosure includes a program module that is transmitted in real time through an external device.

The above description focuses on the embodiment of the present disclosure, but various changes or modifications may be made thereto at the level of a person skilled in the art. Therefore, it may be understood that such changes and modifications are included within the scope of the present disclosure as long as they do not go beyond the scope of the present disclosure.

| Reference numerals | |
|---|---|
| 100: Washing apparatus | 200: Drying apparatus |
| 300: Management server | 500: User terminal |

What is claimed is:

1. A method for providing guide information after completion of washing, the method comprising:

receiving, by a server communication unit of a management server, a first message notifying an end of washing of laundry from a washing apparatus washing the laundry;

receiving, by the server communication unit, a second message notifying a start of drying from a drying apparatus to dry the laundry of the washing apparatus;

calculating, by a server controller of the management server, a time duration for which the laundry has been left in a neglected manner in the washing apparatus, based on the first message and the second message;

comparing, by the server controller of the management server, the time duration for which the laundry has been left in a neglected manner in the washing apparatus with a reference time duration; and controlling, by the server controller of the management server, a notification process to the washing apparatus or the drying apparatus, based on the comparing result, wherein the management server further includes server storage for storing therein a previous history of a time duration for which laundry has been left in a neglected manner in the washing apparatus, wherein the time duration of the previous history has been calculated based on information about an end of washing and a start of drying previously respectively transmitted from the washing apparatus and the drying apparatus, and wherein the method further comprises adjusting, by the server controller, the reference time duration or the time duration for which the laundry has been left in a neglected manner in the washing apparatus, based on the history of the time duration for which the laundry has been left in a neglected manner in the washing apparatus.

2. The method of claim 1, wherein the controlling of the notification process includes:

creating, by the server controller of the management server, a notification message to be output from the washing apparatus or the drying apparatus; and transmitting, by the server communication unit, the notification message to at least one of the washing apparatus or the drying apparatus.

3. The method of claim 1, wherein the controlling of the notification process includes:

creating, by the server controller, a request message requesting the washing apparatus or the drying apparatus to output a sound source, based on the comparing result between the time duration for which the laundry has been left in a neglected manner in the washing apparatus and the reference time duration;

transmitting, by the server communication unit, the request message to a sound source server;

creating, by the sound source server, a sound source file based on the request message; and transmitting, by the sound source server, a notification message including the sound source file to at least one of the washing apparatus or the drying apparatus.

4. The method of claim 1, further comprising:

calculating, by the server controller, the reference time duration using local humidity information and temperature information, and storing, by the server controller, the calculated reference time duration in server storage of the management server; and comparing, by the server controller, the time duration for which the laundry has been left in a neglected manner in the washing apparatus with the reference time duration stored in the server storage, and controlling, by the server controller, the notification process based on the comparing result.

5. The method of claim 1, further comprising:

receiving, by the server communication unit, a washing information message including information about the laundry or a laundry washing course from the washing apparatus, or receiving, by the server communication unit, the first message including the information about the laundry or the laundry washing course from the washing apparatus;

calculating, by the server controller, a moisture content ratio of the laundry using the information about the laundry and the laundry washing course; and adjusting, by the server controller, the comparing result between the time duration for which the laundry has been left in a neglected manner in the washing apparatus and the reference time duration, based on the moisture content ratio.

6. The method of claim 1, wherein the method further comprises:

when the time duration for which the laundry has been left in a neglected manner in the washing apparatus has increased or decreased in the previous history of the time duration for which the laundry has been left in a neglected manner in the washing apparatus, controlling, by the server controller, the notification process so that a comment notifying the increase or decrease in the time duration for which the laundry has been left in a neglected manner in the washing apparatus is output from the washing apparatus or the drying apparatus.

7. The method of claim 1, further comprising:

receiving, by the server communication unit, a third message related to performing of a washing function from the washing apparatus after receiving the first message and before receiving the second message; and when the third message includes information about performing of a rinse course of the washing apparatus, controlling, by the server controller, the notification process to include a comment guiding execution of a re-rinse course due to neglect of the laundry.

8. The method of claim 1, further comprising:

generating, by the server controller, a pushing message to be transmitted to a user terminal linked to the washing apparatus and the drying apparatus; and transmitting, by the server communication unit, the pushing message to the user terminal.

9. A management server for providing guide information after completion of washing, the management server comprising:

a server communication unit configured to receive a first message notifying an end of washing of laundry from a washing apparatus washing the laundry, and to receive a second message notifying a start of drying from a drying apparatus to dry the laundry of the washing apparatus; and a server controller configured to:

calculate a time duration for which the laundry has been left in a neglected manner in the washing apparatus, based on the first message and the second message;

compare the time duration for which the laundry has been left in a neglected manner in the washing apparatus with a reference time duration; and control a notification process to the washing apparatus or the drying apparatus, based on the comparing result, wherein the management server further includes server storage for storing therein a previous history of a time duration for which laundry has been left in a neglected manner in the washing apparatus, wherein the time duration of the previous history has been calculated based on information about an end of washing and a start of drying previously respectively transmitted from the washing apparatus and the drying apparatus, and wherein the server controller is configured to adjust the reference time duration or the time duration for which the laundry has been left in a neglected manner in the washing apparatus, based on the history of the time duration for which the laundry has been left in a neglected manner in the washing apparatus.

10. The management server of claim 9, wherein the server controller is configured to create a notification message to be transmitted to the washing apparatus or the drying apparatus, wherein the server communication unit is configured to transmit the notification message to at least one of the washing apparatus or the drying apparatus for controlling the notification process.

11. The management server of claim 9, wherein the server controller is configured to create a request message requesting the washing apparatus or the drying apparatus to output a sound source, based on the comparing result of the time duration for which the laundry has been left in a neglected manner in the washing apparatus with the reference time duration, wherein the server communication unit is configured to transmit the request message to a sound source server for controlling the notification process, wherein the sound source server is configured to create a sound source file based on the request message, and to transmit a notification message including the sound source file to at least one of the washing apparatus or the drying apparatus.

12. The management server of claim 9, wherein the server controller is configured to calculate the reference time duration, based on local humidity information and temperature information and to store the calculated reference time duration in server storage, wherein the server controller is configured to control the notification process, based on a comparing result between the time duration for which the laundry has been left in a neglected manner in the washing apparatus and the calculated reference time duration stored in the server storage.

13. The management server of claim 9, wherein the server communication unit is configured to receive a washing information message including information about the laundry or a laundry washing course from the washing apparatus, or to receive the first message including the information about the laundry or the laundry washing course from the washing apparatus, wherein the server controller is configured to:

calculate a moisture content ratio of the laundry using the information about the laundry and the laundry washing course; and adjust the comparison result between the time duration for which the laundry has been left in a neglected manner in the washing apparatus and the reference time duration, based on the moisture content ratio.

14. The management server of claim 9, wherein when the time duration for which the laundry has been left in a neglected manner in the washing apparatus has increased or decreased in the previous history of the time duration for which the laundry has been left in a neglected manner in the washing apparatus, the server controller is configured to control the notification process so that a comment notifying the increase or decrease in the time duration for which the laundry has been left in a neglected manner in the washing apparatus is output from the washing apparatus or the drying apparatus.

15. The management server of claim 9, wherein the server communication unit is configured to receive a third message related to performing of a washing function from the washing apparatus after receiving the first message and before receiving the second message, wherein when the third message includes information about performing of a rinse course of the washing apparatus, the server controller is configured to control the notification process to include a comment guiding execution of a re-rinse course due to neglect of the laundry.

16. The management server of claim 9, wherein the server controller is configured to create a pushing message to be sent to a user terminal linked to the washing apparatus and the drying apparatus, wherein the server communication unit is configured to transmit the pushing message to the user terminal.

* * * * *